US006731077B1

(12) United States Patent
Cheng

(10) Patent No.: US 6,731,077 B1
(45) Date of Patent: May 4, 2004

(54) MODULARIZED LED ILLUMINATOR

(76) Inventor: Hsin-Hui Cheng, 3F, No. 4, Lane 489, Jinhsin St., Chungho City, Taipei Hsien (TW)

( * ) Notice: Subject to any disclaimer, the term of this patent is extended or adjusted under 35 U.S.C. 154(b) by 0 days.

(21) Appl. No.: 10/409,908

(22) Filed: Apr. 8, 2003

(51) Int. Cl.[7] ..... G05F 1/00

(52) U.S. Cl. ..... 315/291; 315/312; 315/318; 362/226; 362/227; 362/240; 362/555; 362/800

(58) Field of Search ..... 362/226, 227, 362/240, 236, 800, 555, 559; 315/166, 200 R, 205, 212, 276, 282, 291, 312, 318

(56) References Cited

U.S. PATENT DOCUMENTS 4,298,869 A * 11/1981 Okuno ..... 345/82
5,374,825 A * 12/1994 Doty et al. ..... 250/372
5,404,282 A * 4/1995 Klinke et al. ..... 362/249
5,410,328 A * 4/1995 Yoksza et al. ..... 345/82
5,803,579 A * 9/1998 Turnbull et al. ..... 362/516
6,471,388 B1 * 10/2002 Marsh ..... 362/559
6,528,954 B1 * 3/2003 Lys et al. ..... 315/291

* cited by examiner

*Primary Examiner*—Haissa Philogene
(74) *Attorney, Agent, or Firm*—Charles E. Baxley

(57) ABSTRACT

The invention provides a modularized LED illuminator, wherein each module includes a power block and an illuminating block. The power block treats the extra power with rectification and transformation so that a working voltage is generated to the illuminating block for illuminating. Multiple modularized LED illuminators are connected in series or parallel to obtain larger brightness and modular connection.

10 Claims, 5 Drawing Sheets

MODULARIZED LED ILLUMINATOR

BACKGROUND OF THE INVENTION

1. Field of the Invention

The invention relates to an illuminator using LED (Light Emitting Diode) as light source, and more particularly to illuminator composed of modular connected LED.

2. Description of Related Art

The LED has advantages of smaller volume, and higher efficiency. The technical progress leads to the continuous improvement of the photo-electric transfer efficiency of LED. Research and development are continuously invested into the LED. Thus the LED now has the high potential to be illuminating light source.

LED has been widely employed as illuminating devices with the improvement of brightness of LED. Besides indicators and traffic signal lamps, LED is gradually used in the traditional lamp. But there are some drawbacks. First, most of the conventional LED illuminators are designed into an illuminator with fixed brightness so that the conventional LED illuminators do not satisfy the need for larger brightness. Furthermore, all the components of the conventional LED illuminators are consumables. When the LED illuminator does not work, it has to be replaced with a new one without any possible of repairing.

It is concluded that modularized LED illuminators are more convenient for the users. Therefore, it is necessary to develop modularized LED illuminators.

OBJECTS AND SUMMARY OF THE INVENTION

It is therefore a main object of the invention to provide a LED illuminator that is designed into modular connector for replacing the damaged LED module individually without changing a new set, and facilitating to compose a bigger size of illuminator with desired number of LED modules to obtain desired brightness.

The modularized LED illuminator is comprised of a power block and an illuminating block, wherein said power block is used for rectifying the power source and transforming the voltage of the rectified power source such that a working voltage is generated to the illuminating block for illuminating.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow illustration only, and thus are not limitative of the present invention, and wherein.

DETAILED DESCRIPTION OF PREFERRED EMBODIMENTS

The modularized LED illuminator provided by the invention includes a set of modules with modularized-connection function. Several embodiments are disclosed under the principle of the invention.

Figure 1:
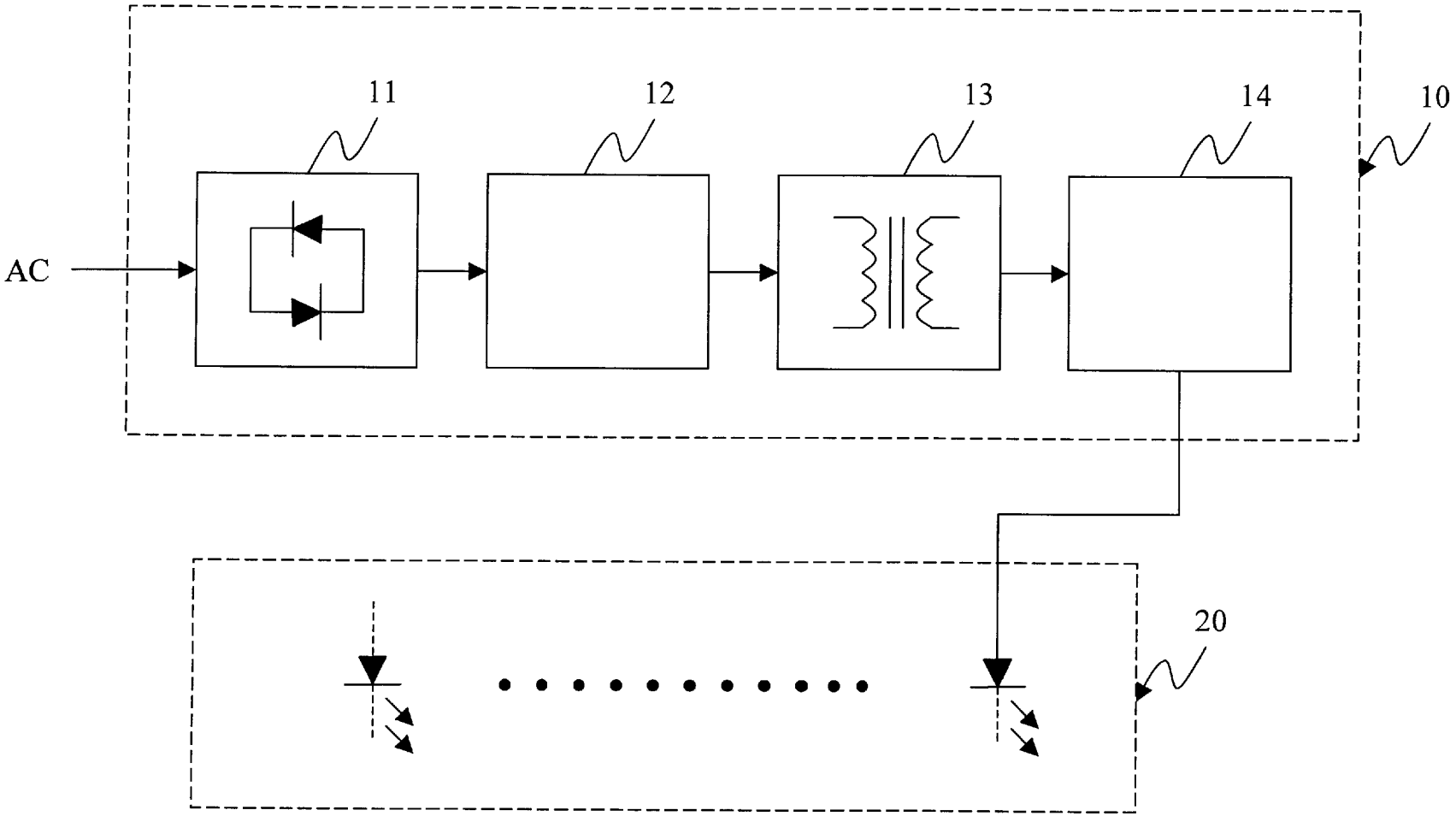
FIG. 1 is a system block-diagram showing the first embodiment of the invention.

Refer to FIG. 1 showing the system block-diagram of the first embodiment of the invention. The first embodiment of the invention is suitable for the different AC power voltage in different countries worldwide. The power block 10 is composed of a rectification unit 11, a voltage dropping unit 12, a voltage transforming unit 13 and a voltage regulating unit 14. The rectification unit 11 is connected to the AC power for commutating the AC power into DC (Direct Current), and send to the voltage dropping unit 12. A full-wave or half-wave rectifier can be selected as the rectification unit 11. The voltage dropping unit 12 is connected to the output of the rectification unit 11 for dropping the DC power into a desired voltage. The voltage dropping unit 12 is composed of low power off-line switchers so as to suit the different power voltage in different countries. After the DC power is dropped by the voltage dropping unit 12, it is transformed into a working voltage by the transformation unit 13. Finally passing through the voltage regulation unit 14, the working voltage is sent to the illuminating block 20. The illuminating block 20 is composed of at least one LED. The illuminating block 20 illuminates after receiving the regulated working voltage.

Figure 2:
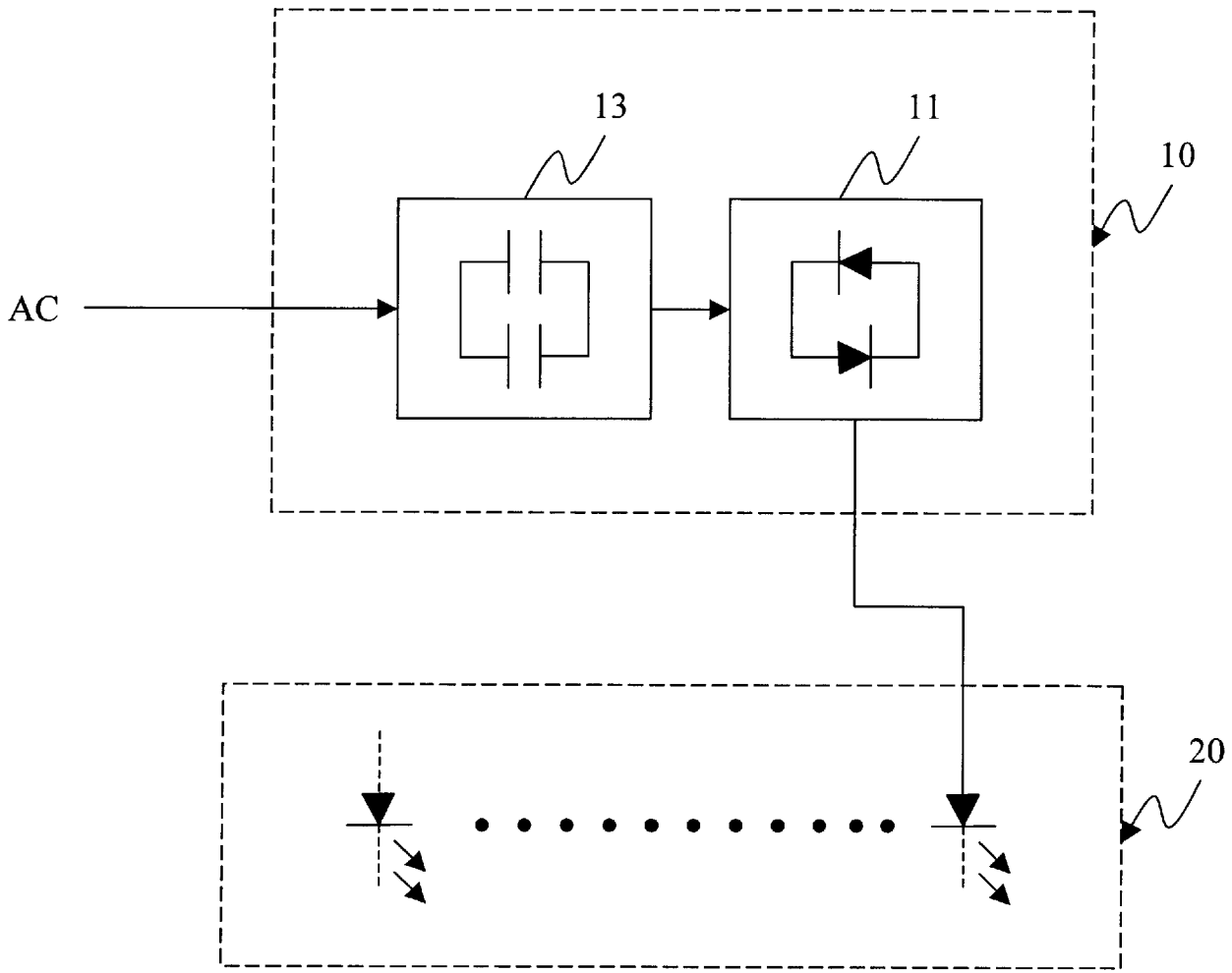
FIG. 2 is a system block-diagram showing the second embodiment of the invention.

The second embodiment of the invention shown in FIG. 2 will be further explained as follows.

The power block 10 of the second embodiment of the invention is comprised of a voltage transforming unit 13 and a rectification unit 11. The voltage transforming unit 13 coupled to the AC power source is composed of a plurality of capacitors to achieving the voltage transforming function. The AC power source is transformed into an AC working voltage and then delivered to the rectification unit 11. The rectification 11 is a full-wave or a half-wave rectifier for commutating the AC working voltage into a DC working voltage, and then delivered to the illuminating block 20. The illuminating block 20 is composed of at least one LED. The illuminating block 20 illuminated after receiving the DC working voltage.

Figure 3:
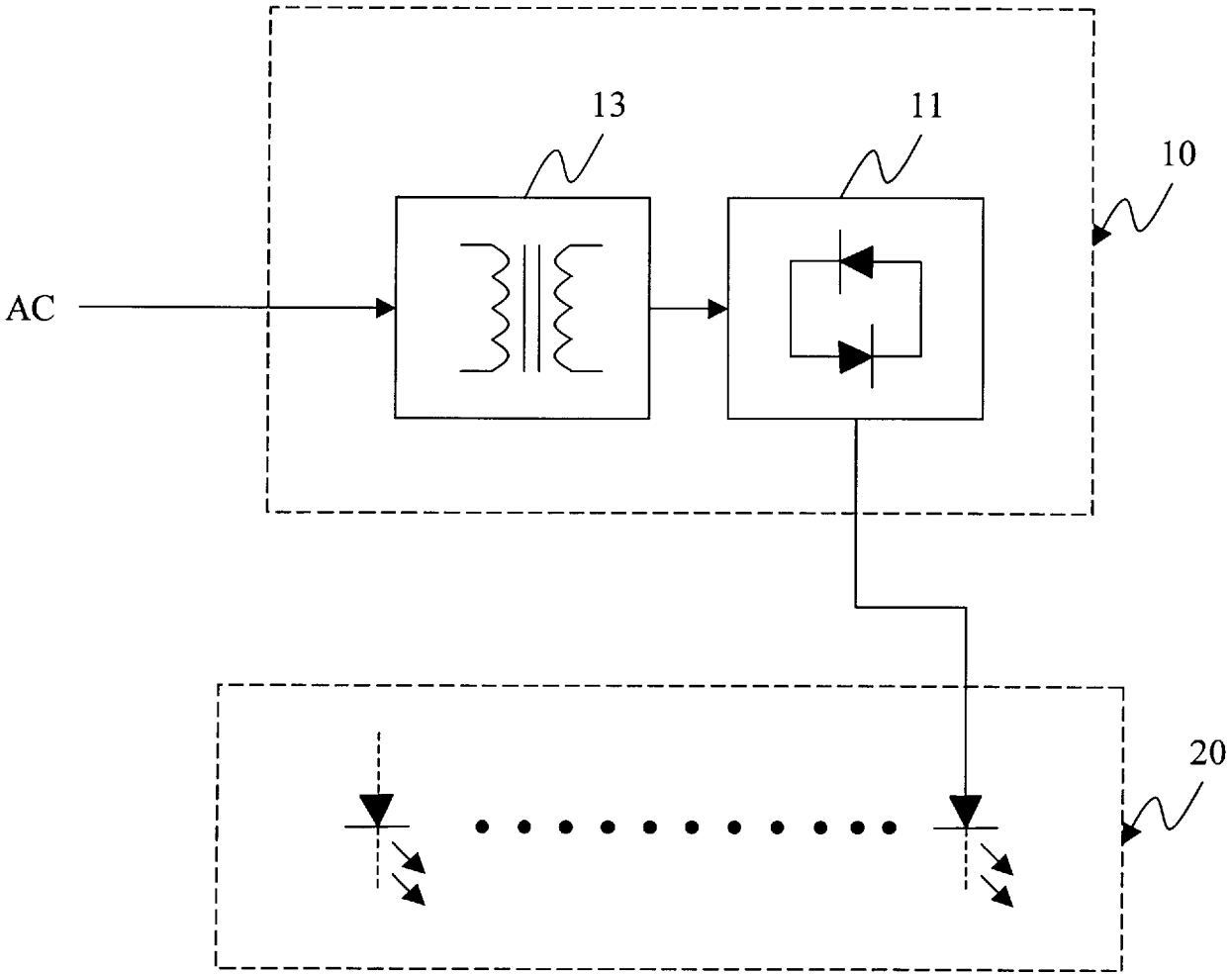
FIG. 3 is a system block-diagram showing the third embodiment of the invention.

In follows the third embodiment of the invention will be described in details, cooperating to the system block-diagram shown in FIG. 3.

The power block 10 of the third embodiment of the invention is comprised of a voltage transforming unit 13 and a rectification unit 11. The voltage transforming unit 13 is connected to the AC power source. The voltage transforming unit 13 is comprised of a transformer for transforming the AC power source into an AC working voltage which is then sent to the rectification unit 11. The rectification 11 is a full-wave or a half-wave rectifier for commutating the AC working voltage into a DC working voltage which is then conducted to the illuminating block 20. The illuminating block 20 is composed of at least one LED. The illuminating block 20 illuminated after receiving the DC working voltage.

Figure 4:
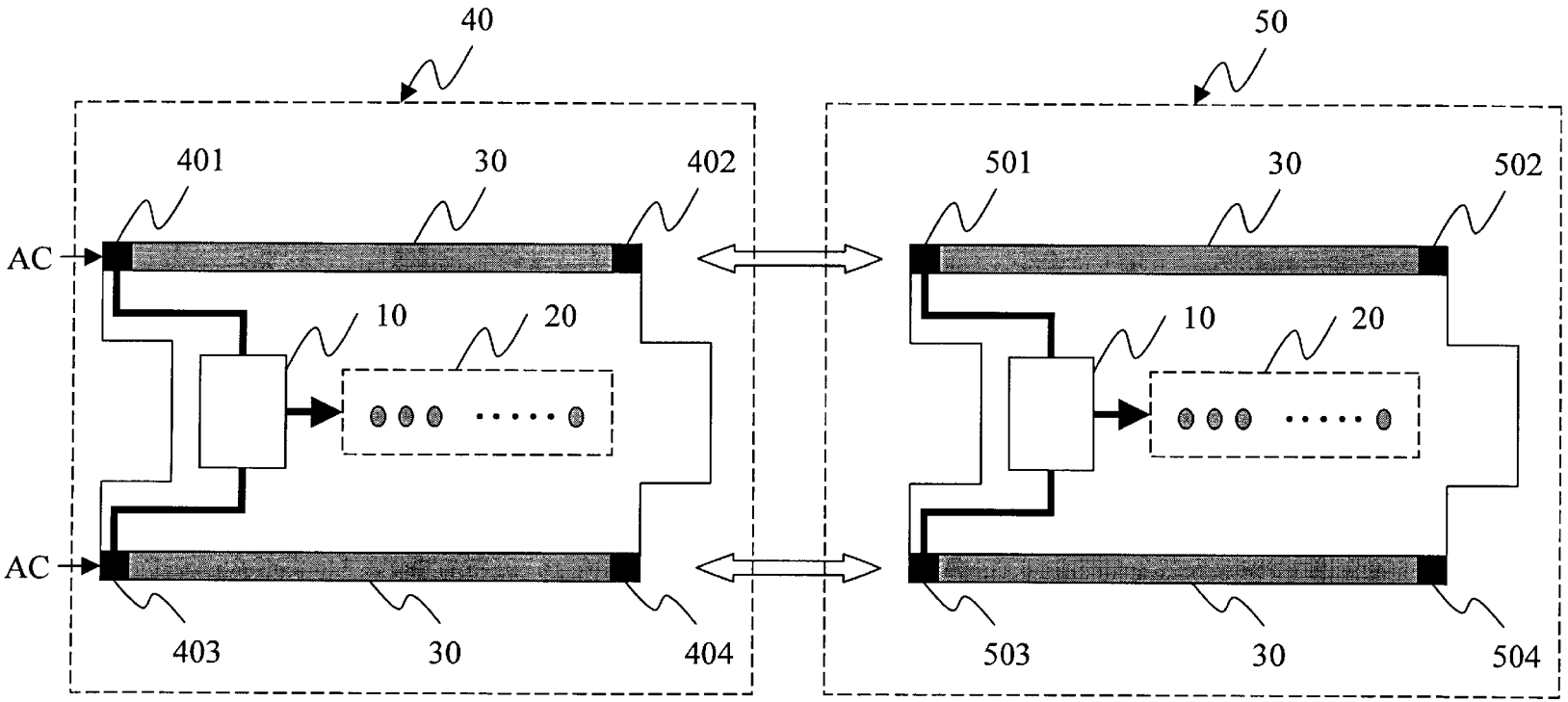
FIG. 4 is a diagram showing the LED modules of the invention connected in series.

Finally, the connection structure of the LED modules is minutely described cooperating to the connecting diagram shown in FIG. 4. The first LED module 40 and the second LED module 50 include respectively an AC circuit 30, two input terminals and two output terminals. The four terminals are symmetrically set upon the ends of two AC circuits 30 to form a module block for connection.

The first module 40 adopts the first input terminal 401 and the second output terminal 403 for receiving the AC power source and then delivering to the power block 10 and the illuminating block 20. Furthermore, the AC power is transmitted to the first output terminal 402 and the second output terminal 404 through the AC circuit 30 and to the third input terminal 501 and the fourth input terminal 503 of the second module 50 to construct a series connection for supplying the AC power to the second module 50. Meanwhile, the AC power source is also delivered to the third output terminal 502 and the fourth output terminal 504 for connecting more modules.

Figure 5:
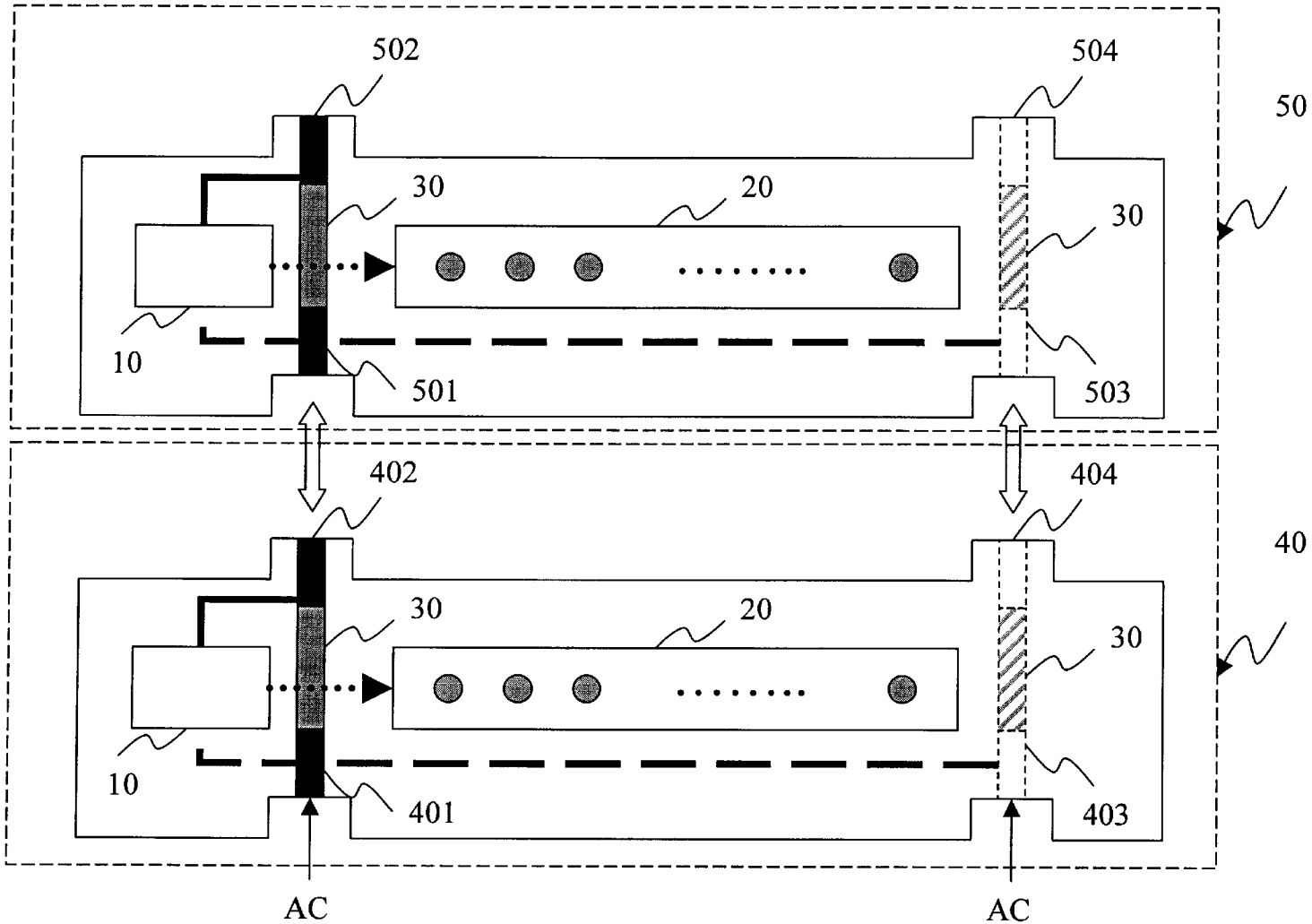
FIG. 5 is a diagram showing the LED modules of the invention connected in parallel.

Besides the series connection, the invention also provides a parallel connection for achieving the modularized connection. Refer to FIG. 5 showing a connecting diagram.

The inner blocks of the first module 40 and the second module 50 are the same as above-mentioned in FIG. 4. The difference in this embodiment is the AC circuit 30. A PCB (Printed-Circuit-Board) is used to implemented the AC circuit 30 for smoothing the AC circuit loop. In case that the first input terminal 401 and the second input terminal 403 (and the third input terminal 501 and the fourth input terminal 503) are designed on the topside of the PCB, the first output terminal 402 and the second output terminal 404 (and the third output terminal 502 and the fourth output terminal 504) are laid on the bottom side.

In the both above-mentioned connection methods, the coordinating terminals can be welded up with metal respectively, or joint in mechanical way (like in joggle joint and so on) for keeping the circuit closed and intensive joint.

In practice, multiple modularized LED modules can be assembled according to the desired brightness. The selectivity and convenience is better than that of the conventional LED illuminator. Because employing a Low Power Off-line switchers and a transformer in the voltage dropping unit, the voltage response is better than that of the conventional LED illuminator.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. A modularized LED illuminator with modular-connection function comprising:

a modularized block, which is connected to an AC power source comprising:

at least one input terminal, which is connected to the adjacent modularized LED illuminator, for receiving the AC power source;

at least one AC circuit, which is connected to said input terminal, for delivering the AC power source; and at least one output terminal, which is connected to said AC circuit, for delivering the AC power source to the next adjacent modularized LED illuminator;

a power block, which is connected to the AC power source, comprising:

a rectification unit, for commuting the AC power source into a DC power source and then outputting to the output terminals;

a voltage dropping unit, which is connected to said rectification unit for dropping the voltage of the DC power source and then outputting to the output terminals;

a voltage transforming unit, which is connected to said voltage dropping unit for transforming said DC power source into a working voltage and outputting to the output terminals; and a regulation unit, which is connected to said voltage transforming unit for stabilizing the working voltage and outputting to the output terminals;

an illuminating block, which is connected to said regulation unit for receiving said working voltage and then illuminating.

2. A modularized LED illuminator as claimed in claim 1, wherein said rectification unit is a full-wave rectifier.

3. A modularized LED illuminator as claimed in claim 1, wherein said rectification unit is a half-wave rectifier.

4. A modular LED illuminator as claimed in claim 1, wherein said voltage dropping unit is a Low Power Off-line Switchers.

5. A modular LED illuminator as claimed in claim 1, wherein said voltage transforming unit is a transformer.

6. A modularized LED illuminator with modular-connection function comprising:

a voltage transformation unit, which is connected to an AC power source for transforming the AC power source into an AC working voltage and then outputting to output terminals;

a rectification unit, which is connected to said voltage transformation unit for commuting said AC working voltage into a DC working voltage and outputting to output terminals;

an illuminating block, which is connected to a regulation unit for receiving said DC working voltage and then illuminating; and a modularized block, which is connected to an AC power source comprising:

at least one input terminal, which is connected to the adjacent modularized LED illuminator, for receiving the AC power source;

at least one AC circuit, which is connected to said input terminal, for delivering the AC power source; and at least one output terminal, which is connected to said AC circuit, for delivering the AC power source to the next adjacent modularized LED illuminator.

7. A modular LED illuminator as claimed in claim 6, wherein said voltage transforming unit is a transformer.

8. A modular LED illuminator as claimed in claim 6, wherein said voltage transforming unit comprises a plurality of capacitors connected in parallel.

9. A modular LED illuminator as claimed in claim 6, wherein said rectification unit is a full-wave rectifier.

10. A modular LED illuminator as claimed in claim 6, wherein said rectification unit is a half-wave rectifier.

* * * * *